US006402134B1

(12) United States Patent
Gauger et al.

(10) Patent No.: US 6,402,134 B1
(45) Date of Patent: Jun. 11, 2002

(54) PROCESS AND APPARATUS FOR ATTACHING FLAT PRODUCTS

(75) Inventors: Hans-Ernst Gauger; Björn Michel, both of Stuttgart (DE)

(73) Assignee: LTG Mailander GmbH (DE)

( * ) Notice: Subject to any disclaimer, the term of this patent is extended or adjusted under 35 U.S.C. 154(b) by 0 days.

(21) Appl. No.: 09/524,059

(22) Filed: Mar. 13, 2000

(30) Foreign Application Priority Data

Mar. 13, 1999 (DE) ..... 199 11 273

(51) Int. Cl.[7] ..... B65H 3/14

(52) U.S. Cl. ..... 271/12; 271/10.06; 271/10.07; 271/94; 271/106; 271/107; 271/197; 271/18.1

(58) Field of Search ..... 271/11, 12, 10.03, 271/10.06, 10.07, 94, 106, 107, 197, 18.1

(56) References Cited

U.S. PATENT DOCUMENTS

| | | | | |
|---|---|---|---|---|
| 3,796,424 A | * | 3/1974 | Fox | 271/1 |
| 3,913,906 A | | 10/1975 | Vits | |
| 4,157,177 A | * | 6/1979 | Strecker | 271/197 |
| 4,451,028 A | * | 5/1984 | Holmes et al. | 271/11 |
| 4,637,589 A | | 1/1987 | Eerola | |
| 4,648,587 A | * | 3/1987 | Hiromori et al. | 271/12 |
| 4,768,769 A | * | 9/1988 | Roller | 271/11 |
| 5,391,051 A | | 2/1995 | Sabatier et al. | |
| 5,785,311 A | * | 7/1998 | Doery | 271/110 |
| 6,244,586 B1 | | 6/2001 | Gauger et al. | |

FOREIGN PATENT DOCUMENTS

| | | |
|---|---|---|
| DE | 2328007 | 11/1974 |
| DE | 2431333 | 1/1976 |
| DE | 8709967 | 10/1987 |
| DE | 273416 | 11/1989 |
| DE | 4205553 | 8/1993 |
| DE | 4323905 | 1/1995 |
| DE | 29502103 | 5/1995 |
| DE | 19511296 | 10/1996 |
| EP | 080865 | 6/1986 |
| EP | 0915041 | 5/1999 |
| GB | 2280425 | 2/1995 |

OTHER PUBLICATIONS

European Search Report for Application No.00105240 dated Sep. 13, 2001.

* cited by examiner

*Primary Examiner*—Christopher P. Ellis
*Assistant Examiner*—Mark A. Deuble
(74) *Attorney, Agent, or Firm*—Ostrolenk, Faber, Gerb & Soffen, LLP

(57) ABSTRACT

A method is proposed for separating flat, stacked products, which are preferably fed individually, at a distance from one another and lying one behind another, to a further processing process, first of all the uppermost product being lifted, at least partially and preferably completely, off the stack of products and subsequently transported away in the transport direction to the further processing process, the transport direction forming an angle (α), preferably in the range from 30° to 150° with the vertical axis of the stack of products, wherein the products are transported away in such a way that as a product that still partially overlaps the stack with its trailing edge region is being transported away, a following product is already being lifted off the stack of products, in its trailing edge region, to be transported away.

12 Claims, 3 Drawing Sheets

PROCESS AND APPARATUS FOR ATTACHING FLAT PRODUCTS

DESCRIPTION

The invention relates to a method of separating flat, stacked products according to the preamble of claim 1 and to a separating apparatus for separating flat products according to the preamble of claim 2.

A method and a separating apparatus of the type mentioned here are known. In order to process flat products further, for example sheet-metal panels, sheets of paper or board, these are provided stacked on one another. In order to feed them to a further processing apparatus, for example a printing machine, the flat products are picked up individually from the stack. For this purpose, it is known to arrange a stack of products under a feeder with a separating apparatus. The separating apparatus comprises a pick-up device having a lifting element for the product resting at the top of the stack. Using the lifting element, the respective uppermost product is lifted, so that said product can be transferred to a transport device, which leads the product to the further processing apparatus arranged downstream of the separating apparatus. Depending on the number of products picked up from the stack, the remaining stack of products is moved up with the aid of a lifting device, so that the respective uppermost product is located in the access range of the lifting element. The drawback with the known method and the apparatus is that lifting the uppermost product off the stack of products can take place only when the previous product has been removed from the stack of products, with the aid of the transport device, to such an extent that its trailing edge region no longer overlaps the stack of products. As a result, only a correspondingly low number of products per unit time can be separated and fed to the further processing apparatus.

It is therefore the object of the invention to specify a method of separating flat, stacked products with which a large number of products per unit time can be lifted off the stack of products and fed to a further processing process. A further objective of the invention is to provide an apparatus for implementing the method which preferably has a simple construction.

In order to achieve this object, a method of separating flat, stacked products is proposed which has the features cited above. In order to process the flat products further, in particular sheet-metal panels, sheets of paper or board, these are picked up individually one after another from the stack of products and fed individually to a further processing process. After the uppermost product has been lifted off the stack of products, it is transported away in the transport direction to the further processing process. In this case, provision is made for the transport direction to be inclined with respect to the vertical axis of the stack of products by an angle which preferably lies in the range from 30° to 150°. The "vertical axis" of the stack of products is understood to mean that axis which extends orthogonally to the base area of the stacked products. The method is distinguished by the fact that as the product that still partially overlaps the stack with its trailing edge region is transported away, a following product is already being lifted off the stack of products, in its trailing edge region, to be transported away. This is possible since a lifting action which is partially carried out is carried out outside the region of overlap with the preceding product, and because of its elasticity the product permits a preferably S-shaped bend, so that the leading edge region of the product which is located in the overlap region still rests on the stack while the trailing edge region is already being lifted. If the product has a high stiffness, it will bend only little elastically, that is to say as it is lifted it passes through a number of tilting movements. In conjunction with the present invention, the term "overlap" is understood to mean that—as viewed transversely with respect to the transport direction of the product—the trailing edge region of the previous product is still located above the stack of products while the following product is already being lifted off the stack of products. Viewed in plan view, therefore, the previous product, being transported away, still partially covers the stack of products during the action of partially lifting the following product. By this means, by comparison with the method known from the prior art, more products per unit time can be processed, so that the utilization of a subsequent further processing process can be optimized.

In order to achieve the object, an apparatus for separating flat, stacked products having the features cited above is also proposed. The apparatus comprises a pick-up device and a transport device, which are used to lift the uppermost product off the stack of products and to transport the separated products away. The products are preferably fed to a further processing apparatus. In connection with the present invention, the term "further processing apparatus" is also understood to mean a product transport device or separating apparatus or the like for the products. The transport direction, in which the goods are transported away, forms with the vertical axis of the stack of products an angle which preferably lies in the range from 30° to 150°. The apparatus is distinguished by the fact that the transport device has at least two overhead transporting means which—as viewed in the transport direction—are arranged one behind another and in each case above the stack of products and in each case in a position overlapping the stack of products. On the basis of this configuration, it is possible that while a product already lifted off the stack of products is being transported away and, at the same time, its trailing edge region still overlaps the stack of products, the following product, located at the top of the stack of products, is already being partially lifted off the stack of products. As a result, more producers can be separated per unit time than in the case of the separating apparatus known from the prior art, as a result of which the utilization of a further processing apparatus connected downstream of the separating apparatus can be optimized.

In a preferred embodiment of the separating apparatus, provision is made for the transporting means to be constructed as overhead suction belt sections. In each case, these comprise at least one endless belt, referred to as a run, which is led over rollers, rolls or other guide devices, it being possible for at least one of the rollers/rolls to be driven to rotate and preferably to be braked. The endless belt is provided with a number of passage openings and, on its side facing away from the product, can have a vacuum applied to it, which makes it possible to pick up the product by suction and hold it on the endless belt. The vacuum serving to achieve an adhesive action (suction action) is preferably adjustable or can be switched (on/off switching). The construction and the functioning of an overhead suction belt section are known, so that they do not need to be discussed specifically here.

In another design variant, provision is made for the overhead suction belt section to have a number of narrow belts, arranged at a distance from one another and transversely with respect to the transport direction of the product, in particular endless belts, whose respective width is less than that of the product.

In another exemplary embodiment of the separating apparatus, provision is made for the transporting means to be constructed as overhead magnetic sections, which can be employed in the case of products consisting of ferromagnetic material. Each of the overhead magnetic sections comprises at least one endless belt/belt run led over rollers, rolls or other guide devices, as well as at least one electromagnet, which can preferably be switched on and off, and/or at least one permanent magnet. The magnet can be arranged to be fixed in position with respect to the run, which can be driven and preferably also braked, on the side facing away from the product to be transported. Of course, it is also possible for the at least one magnet to be fitted to the endless belt on the side thereof facing toward or facing away from the product. In addition, in the case of the transporting means constructed as overhead magnetic sections, these can in each case comprise a number of endless belts arranged beside one another at a distance—as viewed in the transport direction of the product—which are provided or interact in each case with at least one electromagnet or permanent magnet. In a different design variant of the overhead magnetic sections, these each comprise a linear motor, whose construction and functioning are known per se. The product to be transported and consisting of ferromagnetic material, which is displaced in translator fashion, in this case forms the moving part ("rotor") of the linear motor, which is displaced with respect to the stationary part ("stator") of the linear motor.

In a preferred embodiment, provision is made for the pick-up device to have a number of pick-up means. These are arranged transversely with respect to the transport direction of the product, preferably beside one another and distributed at a distance from one another, preferably in the trailing edge region of the products lying on the stack. In a first design variant, a pick-up means is formed by at least one lifting sucker. The latter comprises, for example, a piston/cylinder unit, to whose moving part (piston rod or cylinder) there is fitted a suction head to which vacuum can be applied and which, by moving the moving part, can be displaced in the direction of the uppermost product lying on the stack and in the opposite direction. The suction head is constructed in such a way that the product can be picked up by suction and held, so that the product can be lifted off the stack by means of a displacement of the moving part of the cylinder/piston unit. In another design variant, the pick-up means is formed by at least one lifting magnet, which can be employed to separate products consisting of ferromagnetic material. The lifting magnet comprises, for example, a piston/cylinder unit, to whose moving part (piston rotor cylinder) at least one permanent magnet and/or an electromagnet which can be switched on and off is fixed. Of course, it is possible that, in the case of products consisting of ferromagnetic material, the pick-up device can comprise pick-up means formed both by lifting suckers and by lifting magnets.

Furthermore, an exemplary embodiment of the separating apparatus is preferred in which at least one of the transporting means at the same time executes the function of the pick-up device or one of the pick-up means. The transporting means is therefore constructed in such a way that it performs the action of lifting the uppermost product off the stack of products and also the action of transporting it away. In addition or else alternatively, it is possible for the action of lifting the uppermost product off the stack of products, initiated by a pick-up device, to be assisted by the transporting means.

In a particularly preferred embodiment, provision is made for the transporting means, arranged behind one another in the transport direction, to have drives that operate independently of one another. This is because it is possible that, for example, a first transporting means is in the rest position, that is to say at a standstill, when the uppermost product is being lifted partially off the stack of products, while the second transporting means, which—as viewed in the transport direction—is arranged downstream of the first transporting means, is transporting a product already lifted completely off the stack in the direction of the further processing apparatus. It is preferable if the transport speed of the product to be transported can be adjusted or controlled with the aid of a control or regulating system for the drives.

In addition, an exemplary embodiment of the separating apparatus is preferred if it is distinguished by the fact that the overhead holding functions of the transporting means located in a position overlapping the stack of products can be activated or deactivated independently of one another. The overhead holding function is implemented, for example, with the aid of a vacuum and/or magnetic action in each case. On the basis of this configuration, it is possible for a product lifted off the stack of products to be displaced in the transport direction only by one of the two transporting means and held in the process, while the other transporting means, which the product has already left, is located in a passive functional position, that is to say in particular has been braked down to a standstill, in order to be able to accept the following product.

Finally, an exemplary embodiment of the separating apparatus is also preferred in which—as viewed in the transport direction—an overhead outlet section, which is located in a position at least partially overlapping the stack of products, is connected downstream of the transport device. The overhead outlet section arranged above the stack of products can be constructed, for example, as a suction belt section or as a magnetic section and can comprise rolls/rollers, for example suction rolls/suction rollers, and/or other—for example stationary—guide devices, as well as an endless belt led over the rolls/rollers/guide devices. The product to be transported can therefore be held on the devices of the overhead outlet section by a suction action and/or by magnetic action. In one design variant, at least some of the rolls/rollers are provided with a drive, which permits the rolls/rollers to be driven and braked. In addition, it is possible for the overhead outlet section to have only freely rotating, non-driven rolls,rollers, transport belts or the like with a suction or magnetic device.

The non-driven outlet section makes it possible to stop the adjacent transporting means early. In addition or alternatively, because of such an outlet section, the result is the option—as viewed in the transport direction—of operating an adjoining discharge transport section (reference symbol 53 or 49 in FIG. 2) at a constant, full speed, while the product is accelerated by the transporting means (singular or plural). When the product then passes to the discharge transport section, it has reached full speed, that is to say a jolt-free transfer takes place. The outlet section thus acts as a bridging section for the acceleration of the product.

Further advantageous embodiments of the separating apparatus emerge from the remaining subclaims.

BRIEF DESCRIPTION OF THE DRAWINGS

The invention will be explained in more detail below with reference to the drawing, in which.

DETAILED DESCRIPTION OF PREFERRED EMBODIMENTS

Figure 1:
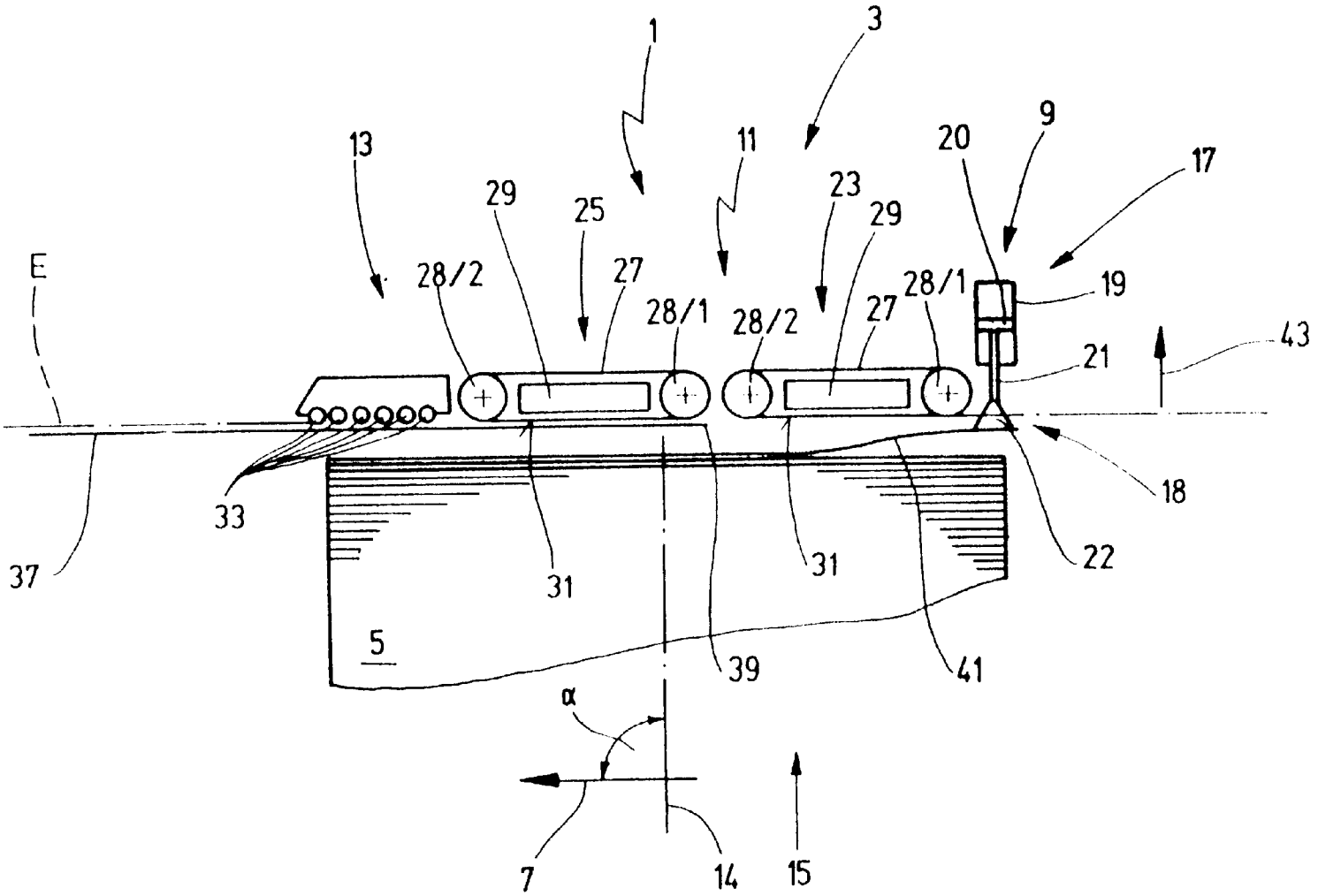
FIG. 1 shows a side view of an exemplary embodiment of the apparatus according to the invention for separating flat, stacked products.

FIG. 1 illustrates an apparatus 1 for separating flat, stacked, flexible products, specifically sheet-metal panels. The separating apparatus 1 for separating the stacked products, which is part of a feeder 3, is connected downstream of a further processing apparatus, not specifically explained here, with which the products can be further processed or transported onward. This further processing apparatus can be, for example, a printing machine or, in general terms, a product transport device.

The separating apparatus i for separating flat products stacked to form a stack 5 comprises—as viewed in the transport direction (arrow 7) of the products—a pick-up device 9, a transport device 11 and an overhead outlet section 13, which are arranged above and at a distance from the stack 5 of products. The stack 5 of products is assigned to a stacking location 15 (not specifically illustrated). As can be seen from FIG. 1, the vertical axis 14 of the stack 5 of products is inclined with respect to the transport direction (arrow 7) of the product, which runs horizontally here, by an angle $\alpha$ which, in this exemplary embodiment, is 90°. The vertical axis 14 is therefore perpendicular to the large surface of the stacked products.

The pick-up device 9 comprises a number of pick-up means 17 which—as viewed in the transport direction (arrow 7)—are arranged beside one another and distributed at a distance from one another over the width of the stack 5 of products. In the illustration according to FIG. 1, only one pick-up means 17 can be seen. In this exemplary embodiment, this is formed by a lifting sucker 18, which comprises a piston/cylinder unit with a cylinder 19, a piston 20 which can be displaced therein and a piston rod 21 that is permanently connected to the piston 20. Fitted to the free end of the piston rod 21 is a suction head 22, to which a preferably adjustable vacuum can be applied. During an extending movement of the piston rod 21, the suction head 22 is displaced in the direction of the stack 5 of products, and during a retraction movement of the piston rod 21, it is displaced into the cylinder 19 in the opposite direction. As can be seen from FIG. 1, the pick-up means 17, which is arranged to be stationary, is arranged in the trailing edge region of the stacked products. Alternatively, provision can also be made as a pick-up device of a lifting sucker bar or suction bar which extends transversely with respect to the transport direction and can be moved up and down.

In the exemplary embodiment of FIG. 1, the transport device 11 comprises a first transporting means 23 and—as viewed in the transport direction (arrow 7)—a second transporting means 25 arranged downstream of the first transporting means 23. The transporting means 23 and 25 have an identical construction and are constructed as overhead suction belt sections. In the following text, their construction will be explained in more detail with reference to the first transporting means 23. This comprises at least one endless belt 27, also referred to as a run or transport belt, which—as viewed in the transport direction (arrow 7)—is led over rollers 28/1 and 28/2 that are arranged at a distance from each other, of which at least one can have a drive and braking torque applied to it with the aid of a drive (not illustrated). It is usual for a number of rollers 28/1, 28/2 to be arranged transversely with respect to the transport direction at a distance from one another on a common shaft, over which a number of narrow endless belts 27 arranged at a distance from one another are led. Arranged in the interspace between the rollers 28/1 and 28/2 is a suction box 29, which is connected to a vacuum source (not illustrated) and to which a preferably adjustable vacuum can be applied. The vacuum prevailing in the interior of the suction box 29 is transferred to the surface 31 of the endless belts 27 facing the stack 5 of products via passage openings in the suction box 29 and in the endless belts 27. The transporting means 23 and 25 can preferably be controlled or regulated independently of one another, which means that preferably both the vacuum in the suction boxes 29 and the drives assigned to the rollers 28/1 and/or 28/2 can be controlled or regulated independently of one another.

The overhead outlet section 13 comprises a number of rollers 33 which are arranged one behind another—as viewed in the transport direction (arrow 7)—and form a roller track and each of which projects with a partial circumferential region into a suction hood 35 to which vacuum can be applied. The rollers 33 are of hollow cylindrical design, the circumference having passage openings, so that a preferably adjustable vacuum prevailing in the interior of the suction hood 35 is transferred via the passage openings to the partial circumferential region of the rollers 33 which can be brought into contact with a product to be transported. It is also possible for the vacuum already transferred, through the interspace between the rollers 33, to the product to be transported to produce an adequate attraction or adhering force to hold the flat product. By this means, it may also be possible to employ rollers without passage openings. In order that they can rotate about their longitudinal mid-axis, the rollers 33 are mounted such that they can move freely. It is preferable for a number of rollers 33 located at a distance from one another to be arranged transversely with respect to the transport direction and at a distance from one another. The rollers 33 are not driven. In a design variant (not illustrated) of the overhead outlet section 13, provision can be made for at least one of the rollers 33, preferably a number of the rollers 33, to be assigned a drive with the aid of which a drive and braking torque can be applied to the roller(s).

As can be seen from FIG. 1, the transport device 11 and/or the first and second transporting means 23 and 25, as well as the overhead outlet section 13, are arranged in such a way that the surfaces of the suction belt sections (endless belts 27) which are in contact with the product to be transported and, respectively, of the rollers 33 are located approximately in a plane E extending horizontally. Furthermore, all the devices in the separating apparatus 1 are arranged in a position in which they overlap the stack 5 of products completely. As seen in a plan view of the stack of products, the pick-up device 9 is therefore located above the trailing edge region, the transport device 11 is located over the central region, and the overhead outlet section 13 is located above the leading edge region of the products lying on the stack of products.

The function of the feeder 3 will be explained in more detail below. It will be assumed that the separating apparatus 1 has been newly started, that is to say no product has yet been transported away, and the product 37 is lying on the top of the stack of products. First of all, with the aid of the lifting suckers 18, the uppermost product 37 is lifted off the stack 5 of products in its trailing edge region and fed to the transporting means 23, while the leading edge region of the product 37 still rests on the stack of products. As a result of the action of the suction box 29 of the first transporting means 23, the flat product 37, in the lifted trailing edge region, is attracted by suction to the endless belts 27 of the first transporting means 23, said belts being at a standstill in this operating phase. As a result of the attractive action of the endless belts 27, to which vacuum is applied, the product 37, hanging down here in an S shape because of its elasticity, is progressively picked up from the stack 5 of products in the form of a wave, until it is finally attracted by suction to the endless belts 27 of the second transporting means. 25, said belts being at a standstill, and to the rollers 33 of the overhead outlet section 13. Only then has the product 37 been lifted completely off the stack 5 of products. During the continuous lifting operation, the S-shaped sag of the product 37, which has partially been lifted and is partially still lying on the stack of products, runs over the stack of products in a wave in the transport direction of the product.

As a result of activation of the drives, the endless belts 27 of the transporting means 23, 25 are accelerated to a desired transport speed, as a result of which the flat product 37 is transported in the direction (arrow 7) of the further treatment apparatus. After the trailing edge 39 of the product 37 has left the first transporting means 23, that is to say the suction belt section of the latter, the endless belts 27 of the first transporting means 23 are braked down to a standstill by means of their drives. Before, at the same time or immediately after this suction belt section has been stopped, the following, uppermost product 41 is lifted off the stack 5 of products in its trailing edge region, with the aid of the lifting suckers 18, is drawn vertically upward (arrow 43) and fed to the transporting means 23, as described with reference to the previous product 37. This operating phase of the feeder 3 is illustrated in FIG. 1. It can be seen that the product 37 that has been lifted completely off the stack 5 of products and is being transported away still overlaps, with its trailing edge region, that part of the following product 41, already lifted in its trailing edge region, still lying on the stack 5 of products.

After the previous product 37 has been transported in the direction of the further processing apparatus to such an extent that its trailing edge 39 has also left the active region (endless belts) of the second transporting means 25, the suction belt section of the second transporting means 25 is then also braked down to a standstill, specifically before the following product 41, already partially lifted off the stack 5 of products, is attracted by suction to or placed against the stationary suction belt section of the second transporting means 25. Finally, the product 41 which, in this operating phase, is still lying on the stack 5 of products, at least in its leading edge region, is lifted completely off the stack 5 of products and also brought into contact with the rollers 33 of the overhead outlet section 13. As a result of the attractive action of the vacuum, the product 41 adheres to the suction belt section and the rollers 33. In order to transport the product 41 away, the suction belt sections of the transporting means 23, 25 are then accelerated to a preferably adjustable transport speed.

The above-mentioned method readily emerges from the description relating to FIG. 1. Its advantage consists in the fact that the braking of the endless belts 27 of the first transporting means 23 can already be carried out while the product lifted completely off the stack and still being transported away with the aid of the second transporting means 25 is still in apposition in which it overlaps the following product lying at the top of the stack of products. Only by means of the above-described interaction of the transporting means 23, 25, which can be operated independently of one another, can the cycle time of the feeder 3 be shortened such that a large number of products per unit time can be picked up from the stack, without any contact or collision occurring between the product already lifted completely and the next following product.

The braking and the accelerating operations of the transporting means 23, 25 are preferably controlled or regulated in such a way that a relative movement between the product being transported away and the suction belt sections of the transporting means 23, 25, or the uppermost product of the stack of products, is avoided, so that damage to the product, for example scratching or kinking, can virtually be ruled out during the actions of lifting it and transporting it away. If the product, that is to say at least its large surface coming into bearing contact with the suction belt sections, should not be sensitive to scratching, it is possible, for example, for the braking operation of the suction belt sections of the transporting means 23, 25 to be initiated when the trailing edge region of the product which has been lifted completely off the stack and is being transported away is still partially overlapping the respective suction belt section and resting against the latter. By this means, the separating speed can be increased further.

As a result of employing the overhead outlet section 13, a further increase in the separating speed, and therefore in the number of products per unit time, is still possible. This is achieved in that the braking of the transporting means 25, that is to say of its suction belt section, is carried out while the individual product lifted completely off the stack of products and being transported away still partially overlaps the following product, which is still lying with its leading edge region on the stack of products and has already been lifted at its trailing edge region.

From all that has been said, it becomes clear that an overlap of the product being transported away with a following product, already partially lifted off the stack of products, is also possible when the separating apparatus does not have an overhead outlet section. The overhead outlet section is preferably always employed when particularly high separating speeds are required. If no overhead outlet section is to be employed, then one of the two transporting means 23, 25 or both transporting means 23, 25—as viewed in the transport direction—can be lengthened appropriately, so that no gaps, or only very small gaps, exist in the transport section of the products above the stack of products.

In an embodiment of the separating apparatus which is not illustrated in the figures, the pick-up device 9 is dispensed with. Its function is then carried out by a different embodiment of the transporting means 23, 25, as described in DE 198 32 847. The content of the description, the claims and the figures of DE 198 32 847 are hereby made the subject of this application. In the case of these transporting means, the vacuum which can be applied to the suction belt sections—as viewed in the transport direction—can be controlled or regulated section by section. In order to lift the uppermost product off the stack in its trailing edge region, that part of the suction belt section arranged above the trailing edge region has an adequately high vacuum applied to it. In order that that product whose trailing edge region has been lifted and whose leading edge region is still lying on the stack of products can be lifted completely and transferred from the stack to the suction belt sections, that longitudinal section of the suction belt sections to which the high vacuum is applied is progressively enlarged in the transport direction. It is preferable if the level of the vacuum can also be adjusted section by section in the transport direction.

Figure 2:
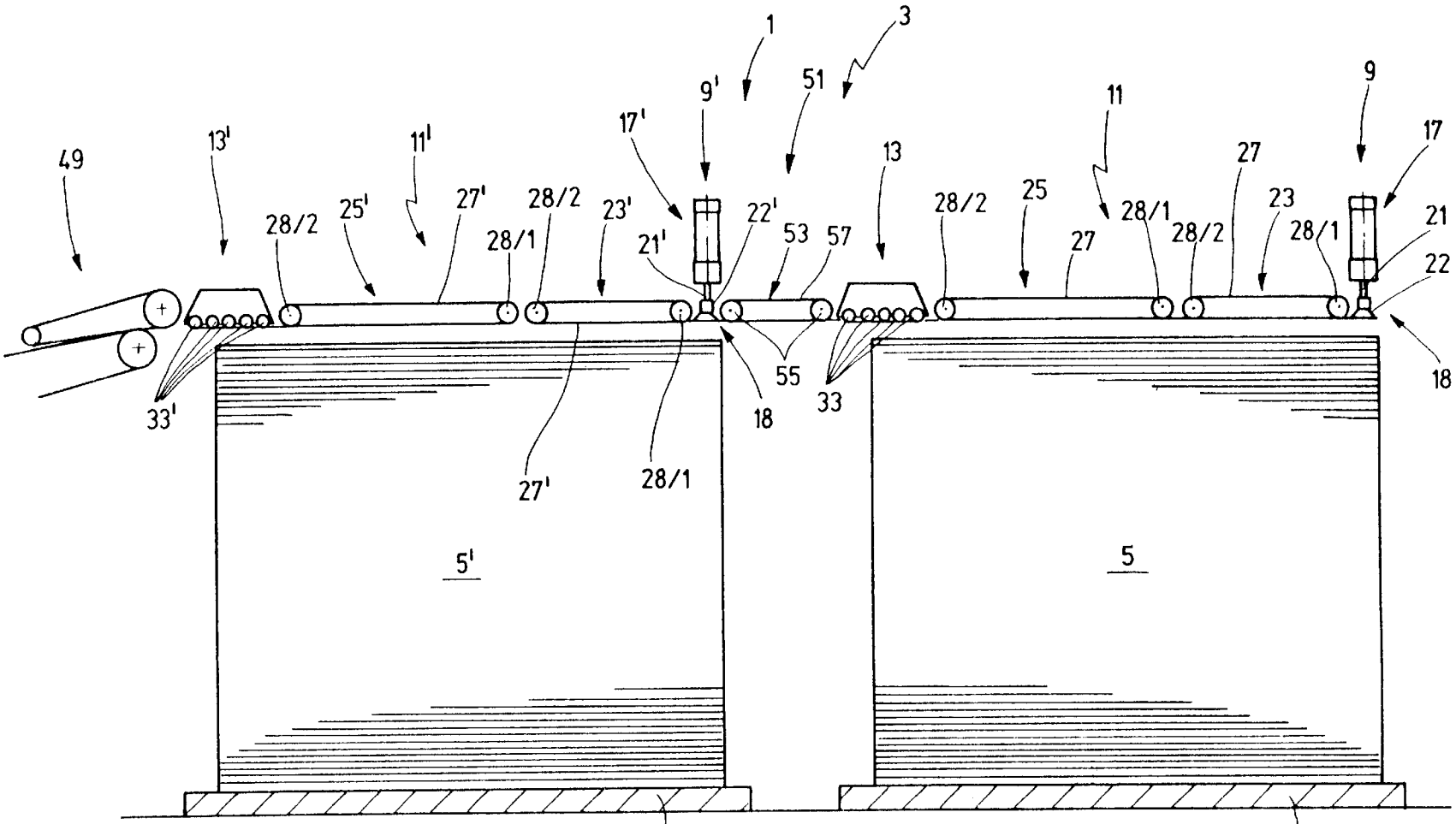
FIG. 2 shows a side view of a further exemplary embodiment having two stacks of products arranged one behind another, with a separating apparatus corresponding to that described with reference to FIG. 1.

FIG. 2 shows a further exemplary embodiment of the separating apparatus 1, which is located above and in a position in which it overlaps two stacks 5 and 5' of products which are arranged one behind another—as viewed in the transport direction (arrow 7). Identical parts of the separating apparatus 1 are provided with identical reference numbers, so that to this extent reference is made to the description relating to FIG. 1.

The stack 5 of products, lying on a pallet 45, is assigned to a first stacking location 15, and the stack 5' of products, lying on a pallet 45', is assigned to a second stacking location 15'. The stacking locations 15, 15' are each assigned a lifting device (not illustrated here) for lifting the pallet 45 and 45', respectively, with the stack 5 or 5' of products resting on it, depending on the number of products picked up from the stack. The construction and the functioning of the lifting devices are known, for example from DE 198 11 166, so that these do not need to be described specifically here.

First of all, all or a specific number of products are picked up from only one of the stacks of products. The products are then picked up from the other stack of products. Of course, it is also possible to pick up a desired number of products alternately in each case from both stacks of products. As soon as a stack of products has reached a predetermined number of products, this stack of products is replaced by a further, new stack of products, it being possible for the products to be picked up one after another from the other stack of products during this replacement operation. By this means, uninterrupted feeding of the separated products to the further processing process is possible. As a result, a large number of products can be processed per unit time, so that the utilization of a further processing apparatus 49 arranged downstream of the separating apparatus 1—as viewed in the transport direction—can be optimized.

The separating apparatus 1 illustrated in FIG. 2 comprises—as viewed in the transport direction—a first pick-up device 9, a first transport device 11 and a first overhead outlet section 13, which are assigned to the first stacking location 15, as well as a second pick-up device 9', a second transport device 11' and a second overhead outlet section 13', which are assigned to the second stacking location 15'. The pick-up devices 9, 9' and the transport devices 11, 11' overlap the stacks 5 and 5' of products completely, while the identically constructed overhead outlet sections 13, 13' only partially overlap the respective stack of goods. The pick-up devices 9 and 9 are of identical construction and comprise a pick-up means 17 and 17', respectively. The transport device 11 comprises two transporting means 23 and 25, and the transport device 11' comprises two transporting means 23' and 25', the construction and the functioning of the transporting means 23' and 25' corresponding to that of the transporting means 23 and 25.

In order to bridge over an interspace 51 between the overhead outlet section 13 assigned to the first stacking location 15, and the pick-up device 9' which follows in the transport direction and is assigned to the second stacking location 15', provision is made for a bridging device 53, which is constructed here as an overhead suction belt section and essentially has the same construction as the transporting means 23, 25, 23' and 25'. The bridging device 53 therefore comprises at least one endless belt 27, normally a number of endless belts 57 that are led over rollers 55, have passage openings and are arranged next to and at a distance from one another. Provided in the interspace between the rollers 55 and the endless belts 57 is a suction box (not illustrated here), with the help of which a preferably adjustable vacuum can be applied to that surface of the endless belts 57 which faces the stack of products. Of course, it is possible for the bridging device 53 arranged between the overhead outlet section 13 and the pick-up device 9' also to be formed by a roller track or the like, whose construction corresponds approximately to that of the overhead outlet sections 13, 13'.

The first pick-up means 17, the transporting means 23, 25 of the first transport device 11, the first overhead outlet section 13, the bridging device 53, the second pick-up means 17', the transporting means 23', 25' of the second transport device 11' and the second overhead outlet section 13' are arranged in this exemplary embodiment in such a way that a transport path extending essentially horizontally is formed for the products lifted individually off the respective stack 5, 5' of products. Moreover, FIG. 2 reveals that the interspaces between the transporting means 23, 25, 23', 25', which are constructed as modular units, the pick-up means 17, 17', the overhead outlet sections 13, 13', the bridging device 53 and the further processing apparatus 49 are only very small.

In the exemplary embodiment illustrated in FIG. 2, the further processing apparatus 49 comprises a transport device (only partially illustrated here), which comprises two belt or transport belt sections. These are arranged in such a way that a closed nip is formed, into which the product is guided as it is transported away.

Figure 3:
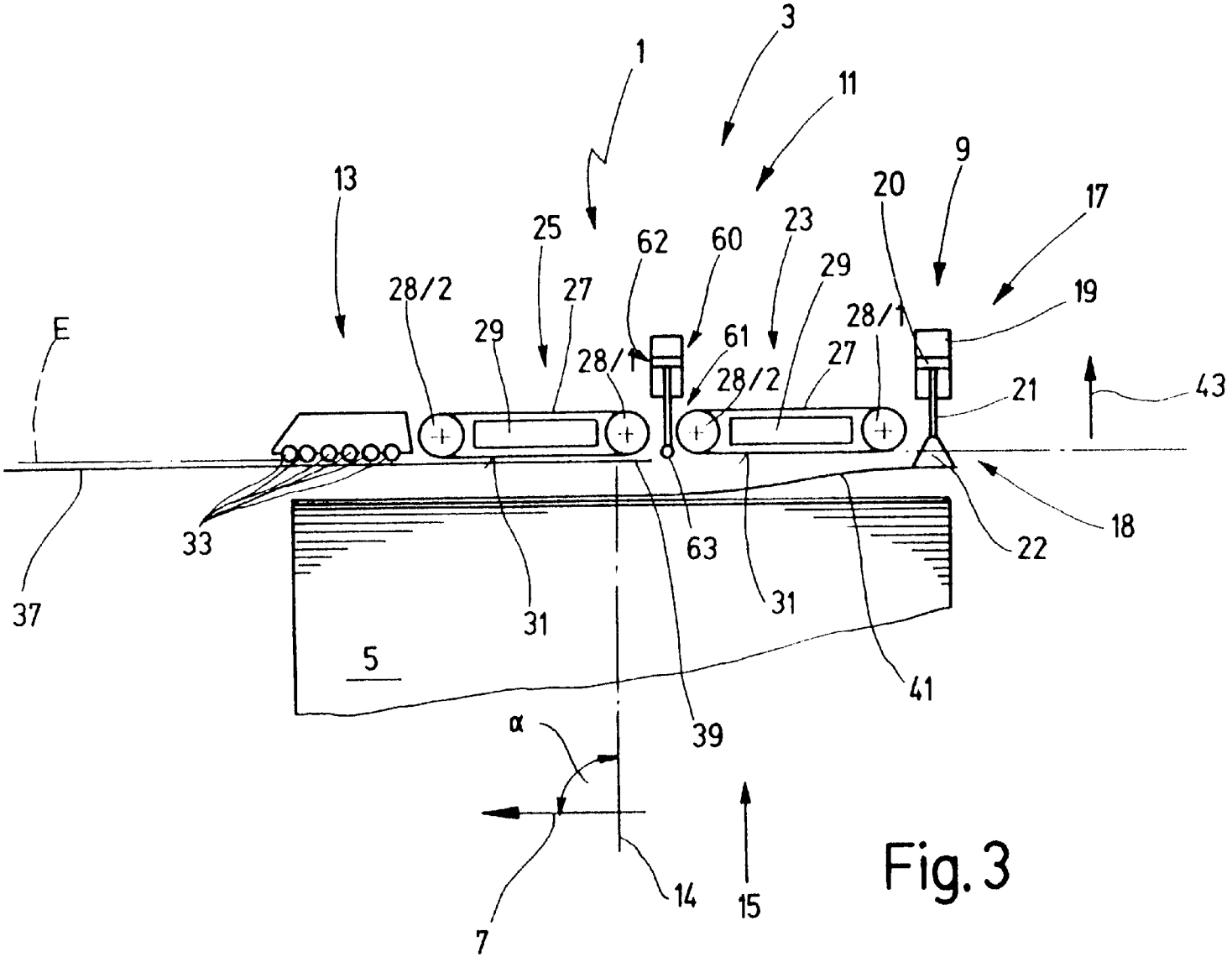
FIG. 3 shows a side view of a further exemplary embodiment of an apparatus according to the invention.

The construction and the functioning, in particular the interaction, of the devices (pick-up device, transport device, overhead outlet section) of the separating apparatus 1 respectively assigned to one stacking location 15, 15' correspond to those of the parts or devices of the separating apparatus 1 described with reference to FIG. 1, so that to this extent reference is made to the description relating to FIG. 1. In the following text, therefore, only the interaction of the devices of the separating apparatus 1 assigned to the stacking locations 15 and 15' will be explained in more detail. While the actions of picking up and separating and transporting away the product from the rear stack 5 of products—as viewed in the transport direction are taking place with the aid of the pick-up device 9, the transport device 11 and the overhead outlet section 13, the pick-up device 9' assigned to the stack 5' of products located in the stacking location 15' is in the rest position (FIG. 2), that is to say its lifting element(s) is/are located outside the transport path of the product. The overhead suction belt sections of the transporting means 23' and 25', which can be controlled or regulated independently of one another and of the transporting means 23, 25, are accelerated to transport speed, so that the individual product lifted off the rear stack 5 of products—as viewed in the transport direction of the product—is transported from the overhead outlet section 13 to the bridging device 53 and, from there, by the transporting means 23' and 25' and the overhead outlet section 13' to the further processing apparatus 49. If the products are to be picked up from the front stack 5' of products, the pick-up device 9, the transport device 11, the overhead outlet section 13 and the bridging device 53 can be switched into a waiting/standby state, since they are not needed for transporting the products lifted individually off the stack 5' of products arranged in the stacking location 15'. In the waiting state, the drives can be switched off, and the connection between the suction box and the vacuum source can be shut off. The actions of separating and transporting away the product lying at the top of the stack 5' of products are carried out with the aid of the pick-up device 9', the transport device 11' and the overhead outlet section 13', reference being made to the description relating to FIG. 1 for their functioning, in particular their interaction with one another. FIG. 3 shows a further exemplary embodiment of the invention, which corresponds to the exemplary embodiment of FIG. 1. To this extent, reference is made to this exemplary embodiment of FIG. 1. The difference is merely that there is a pressing-down device 60, which is preferably designed as a pressing-down bar 61, between the two transporting means 23 and 25. The pressing-down bar 61 extends transversely with respect to the transport direction (arrow 7). By means of a piston/cylinder unit 62, a bar-like retaining element 63 can be moved downward, so that it projects downward beyond the transport plane. The retaining element 63 is preferably configured in such a way that it does not damage or scratch the product 41. The retaining element 63 is moved into the position underneath the running plane as soon as the trailing edge of the previous product has left the position of the pressing-down device 60. By this means, the pick-up device 9 can lift even very lightweight products, for example lightweight sheet-metal panels, without risk while the previous panel is being transported away, even when the latter, because of its inherent type (for example relatively stiff or—as mentioned—very lightweight) tends to "whip up", as a result of which—without the pressing-down device 60—it would strike against the running belt of the transporting means 25. The retaining element 63 prevents this contact, so that uncontrolled transport or a "jolt" on the product does not occur. If contact between the product and the transporting means 25 is desired, the retaining element is withdrawn.

In an exemplary embodiment (not illustrated in the figures) of the apparatus for separating flat, stacked products, their transport device has more than two transporting means, for example three transporting means, which can be controlled or regulated independently of one another, which makes possible very rapid and precise lifting of the uppermost product off the stack of products, as well as its transport to the device downstream.

In an exemplary embodiment which is not illustrated, provision can be made for a non-driven outlet section to be located, or additionally located, between the transporting means 23 and 25 and, respectively, 23' and 25'. This has the advantage that, for example, the transporting means 23 or 23' can then be configured to be relatively small, so that it can be switched off very rapidly, by which means the number of cycles can be increased overall.

The invention is not restricted to the exemplary embodiment(s) of the description. Instead, within the context of the invention, numerous changes and modifications are possible, in particular such variants, elements and combinations and/or materials which are inventive, for example by combining or modifying individual features, elements or method steps described in connection with those in the general description and the embodiments and the claims and contained in the figures, and by means of combinable features lead to a new subject or to new method steps or sequences of method steps.

What is claimed is:

1. A method of separating flat, stacked products, which are fed individually, at a distance from one another and lying one behind another, to a further processing process, the method comprising:

first lifting an uppermost product, at least partially off the stack of products and subsequently transporting away the lifted product in a transport direction to the further processing process, the transport direction forming an angle ($\alpha$) in the range from 30° to 150° with the vertical axis of the stack of products, wherein the products are transported away in such a way that as a product that still partially overlaps the stack with its trailing edge region is being transported away, a following product is already being lifted off the stack of products, in its trailing edge region, to be transported away, and providing an overhead outlet section which receives the uppermost product and guides it further in the transport direction, the overhead outlet section being located in a position at least partially overlapping the stack of products.

2. An apparatus for separating flat, stacked products, which are preferably fed, at a distance from one another and lying one behind another, to a further processing apparatus, including a pick-up device and a transport device, the products being transported away in a transport direction which forms an angle ($\alpha$) in the range from 30° to 150° with the vertical axis of the stack of products, wherein the transport device has at least two transporting devices which are arranged one behind another and in each case above the stack of products and in each case in a position overlapping the stack of products, and including an overhead outlet section which receives the uppermost product and guides it further in the transport direction, the overhead outlet section being located in a position at least partially overlapping the stack of products.

3. The apparatus as claimed in claim 2, wherein the transporting devices are constructed as overhead suction belt sections.

4. The apparatus as claimed in claim 2, wherein the transporting devices are constructed as overhead magnetic sections.

5. The apparatus as claimed in claim 2, wherein the pick-up device has a number of pick-up means.

6. The apparatus as claimed in claim 5, wherein the pick-up means comprises at least one lifting sucker.

7. The apparatus as claimed in claim 2, wherein the transporting devices are constructed as linear motors.

8. The apparatus as claimed in claim 2, wherein the pick-up device comprises at least one lifting magnet.

9. The apparatus as claimed in claim 2, wherein the transporting devices have drives that operate independently of one another.

10. The apparatus as claimed in claim 2, wherein the overhead holding function of the transporting devices can be activated or deactivated independently of one another.

11. An apparatus for separating flat, stacked products, which are fed, at a distance from one another and lying one behind another, and which are located at first and second stacks, wherein the apparatus includes for each stack a pick-up device and a transport device, the products being transported away in a transport direction which forms an angle ($\alpha$) in the range from 30° to 150° with the vertical axis of the stack of products, wherein the transport device has at least two transporting devices which are arranged one behind another and in each case above the stack of products and in each case in a position overlapping the stack of products, and further including an overhead outlet section which receives the uppermost product and guides it further in the transport direction, the overhead outlet section being located in a position at least partially overlapping the stack of products, wherein—as viewed in the transport direction of the product—the first and second stacks of products are arranged one behind another and each has assigned thereto a pick-up device and a transport device, and an overhead outlet section for the products.

12. The apparatus as claimed in claim 11, wherein a bridging device for the products is arranged in the interspace between the stacks of products, which are arranged at a distance from each other.

* * * * *